US011072515B2

(12) United States Patent
Witczak et al.

(10) Patent No.: US 11,072,515 B2
(45) Date of Patent: Jul. 27, 2021

(54) AUTOMATED ELEVATOR MAINTENANCE MODE INITIATION

(71) Applicant: OTIS ELEVATOR COMPANY, Farmington, CT (US)

(72) Inventors: Tadeusz Pawel Witczak, Farmington, CT (US); Michael J. Tracey, Cromwell, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 677 days.

(21) Appl. No.: 15/937,138

(22) Filed: Mar. 27, 2018

(65) Prior Publication Data

US 2019/0300336 A1 Oct. 3, 2019

(51) Int. Cl.
*B65B 5/00* (2006.01)
*B66B 1/28* (2006.01)
(Continued)

(52) U.S. Cl.
CPC ..... *B66B 5/0087* (2013.01); *B66B 1/28* (2013.01); *B66B 1/3407* (2013.01);
(Continued)

(58) Field of Classification Search
CPC ..... B66B 5/0087; B66B 1/28; B66B 1/3407; B66B 1/3461; B66B 1/468; B66B 2201/00; B66B 2201/104; B66B 2201/406; B66B 2201/4653; B66B 1/02; B66B 1/3415; B66B 1/36; B66B 3/02; B66B 5/0025
See application file for complete search history.

(56) References Cited

U.S. PATENT DOCUMENTS 6,223,861 B1 * 5/2001 Sansevero ..... B66B 13/22 187/316
6,330,935 B1 * 12/2001 Systermans ..... B66B 5/0025 187/391
(Continued)

FOREIGN PATENT DOCUMENTS

CN 103068710 A 4/2013
CN 104229577 A 12/2014
(Continued)

OTHER PUBLICATIONS

Extended European Search Report for Application No. EP 19 16 5631 dated Aug. 30, 2019.

*Primary Examiner* — Jeffrey Donels
(74) *Attorney, Agent, or Firm* — Carlson, Gaskey & Olds

(57) ABSTRACT

An illustrative example elevator system includes at least one elevator car that is moveable along a hoistway. An elevator controller is configured to respond to a communication from a portable device indicating a desire for the at least one elevator car to be placed in a maintenance mode and indicating a location of desired hoistway access. The controller automatically moves the elevator car to a determined positon based on the communication. That position corresponds to the location of the desired hoistway access. The controller performs at least one automated procedure to place the elevator car in the maintenance mode. The controller provides an indication to the portable device that the elevator car is in the determined position and that the automated procedure has been completed.

24 Claims, 2 Drawing Sheets

(51) Int. Cl.
*B66B 1/34* (2006.01)
*B66B 1/46* (2006.01)
*B66B 5/00* (2006.01)

(52) U.S. Cl.
CPC ..... *B66B 1/3461* (2013.01); *B66B 1/468* (2013.01); *B66B 2201/00* (2013.01); *B66B 2201/104* (2013.01); *B66B 2201/406* (2013.01); *B66B 2201/4653* (2013.01)

(56) References Cited

U.S. PATENT DOCUMENTS 6,357,553 B1 3/2002 Vialonga
6,405,834 B1 6/2002 Chida et al.
6,868,945 B2 3/2005 Schuster et al.
7,073,633 B2 * 7/2006 Weinberger ..... B66B 5/0025 187/393
7,513,337 B2 * 4/2009 Siikonen ..... B66B 1/2458 187/382
7,954,606 B2 * 6/2011 Tinone ..... B66B 5/005 187/384
8,028,807 B2 * 10/2011 Deplazes ..... B66B 5/0025 187/391
8,136,636 B2 3/2012 Bahjat et al.
8,602,171 B2 12/2013 Vogl
9,284,158 B2 3/2016 Sarjanen
9,517,917 B2 * 12/2016 Tokura ..... B66B 1/16
9,580,272 B2 2/2017 Kappeler et al.
9,580,276 B2 * 2/2017 Toutaoui ..... B66B 5/0087
9,630,804 B2 4/2017 Hovi et al.
10,183,837 B2 * 1/2019 Kusserow ..... B66B 1/3461
10,597,254 B2 * 3/2020 Mahoney ..... B66B 5/0087
2009/0218178 A1 * 9/2009 Lence-Barreiro ..... B66B 5/0025 187/393
2016/0185568 A1 * 6/2016 Kusserow ..... H04W 52/0203 340/3.31
2016/0251199 A1 9/2016 Kronkvist et al.
2016/0311647 A1 10/2016 Peterson et al.
2016/0355375 A1 12/2016 Simcik et al.
2017/0297862 A1 10/2017 Ifland et al.
2018/0150806 A1 * 5/2018 Eleid ..... G06Q 10/20
2018/0247278 A1 * 8/2018 Winz ..... G06T 7/0004
2019/0202660 A1 * 7/2019 Mahoney ..... B66B 5/005
2019/0202662 A1 * 7/2019 Kattainen ..... B66B 5/0087
2020/0317470 A1 * 10/2020 Pahlke ..... B66B 1/3492

FOREIGN PATENT DOCUMENTS

CN 106044429 A 10/2016
CN 107720471 A 2/2018
EP 1281654 A1 2/2003
EP 1882666 A1 1/2008
EP 3546411 A1 * 10/2019 ..... B66B 1/28
JP 2015044677 A 3/2015
WO 2016096699 A1 6/2016
WO 2017112659 A1 6/2017

* cited by examiner

AUTOMATED ELEVATOR MAINTENANCE MODE INITIATION

BACKGROUND

Elevator systems occasionally require maintenance or repair. A technician visits the site of the elevator system and typically requires access to the hoistway. The technician has to perform a series of tasks or procedures to properly place the elevator into maintenance mode.

One of the more challenging aspects of initiating maintenance mode includes capturing the elevator car at an appropriate location based on where the technician desires access to the hoistway. If the technician is not able to stop the elevator car in the right place, that often requires repeating other procedures.

SUMMARY

An illustrative example elevator system includes at least one elevator car that is moveable along a hoistway. An elevator controller is configured to respond to a communication from a portable device indicating a desire for the at least one elevator car to be placed in a maintenance mode and indicating a location of desired hoistway access. The controller automatically moves the elevator car to a determined positon based on the communication. That position corresponds to the location of the desired hoistway access. The controller performs at least one automated procedure to place the elevator car in the maintenance mode. The controller provides an indication to the portable device that the elevator car is in the determined position and that the automated procedure has been completed.

An embodiment having one or more features of the elevator system of the previous paragraph includes a second elevator car and the controller is configured to: determine an access level corresponding to the location of desired hoistway access, determine a boarding level where maintenance personnel can board the second elevator car, automatically cause the second elevator car to arrive at the boarding level based on the communication, and automatically cause the second elevator car to carry the maintenance personnel to the access level.

In an embodiment having one or more features of the elevator system of any of the previous paragraphs, the location of desired hoistway access is one of on top of the at least one elevator car and a pit beneath the at least one elevator car.

In an embodiment having one or more features of the elevator system of any of the previous paragraphs, the at least one automated procedure comprises a plurality of automated procedures and the controller is configured to perform the plurality of automated procedures in a predetermined order based on the location of desired hoistway access.

In an embodiment having one or more features of the elevator system of any of the previous paragraphs, the plurality of automated procedures includes at least verifying a condition of a plurality of hoistway doors along the hoistway and verifying a condition of a maintenance switch.

In an embodiment having one or more features of the elevator system of any of the previous paragraphs, the elevator controller verifies the condition of the hoistway doors by determining whether any of the hoistway doors is open.

In an embodiment having one or more features of the elevator system of any of the previous paragraphs, the elevator controller verifies the condition of the maintenance switch by at least one of automatically setting the maintenance switch into a maintenance mode position and determining whether the maintenance switch is in the maintenance mode position.

In an embodiment having one or more features of the elevator system of any of the previous paragraphs, the controller is configured to receive the communication prior to arrival of maintenance personnel and the portable device at a site of the elevator system, move the at least one elevator car to the determined position prior to or upon arrival of the maintenance personnel and the portable device at the site and complete the plurality of automated procedures prior to or upon arrival of the maintenance personnel and the portable device at the site.

An embodiment having one or more features of the elevator system of any of the previous paragraphs includes the portable device and the portable device comprises a user interface that is configured to allow maintenance personnel to indicate the desire for the at least one elevator car to be placed in the maintenance mode and the location of desired hoistway access to the elevator controller and provide an output to the maintenance personnel indicating at least that the elevator car has arrived at the determined position.

In an embodiment having one or more features of the elevator system of any of the previous paragraphs, the portable device is configured to receive instructions from the elevator controller regarding at least one manual procedure needed to place the at least one elevator car in the maintenance mode prior to the maintenance personnel accessing the hoistway, provide an output corresponding to the at least one manual procedure, receive input from the maintenance personnel indicating that the at least one manual procedure is complete, and provide a confirmation to the elevator controller when the at least one manual procedure is complete.

In an embodiment having one or more features of the elevator system of any of the previous paragraphs, the elevator controller determines whether the at least one elevator car is still in the maintenance mode after a first preselected period of time, the elevator controller communicates with the portable device indicating that the at least one elevator car is still in the maintenance mode after the first preselected period of time, the portable device provides an output for maintenance personnel regarding ending the maintenance mode, and the elevator controller ends the maintenance mode after receiving an indication from the portable device to end the maintenance mode or expiration of a second, longer preselected period of time.

In an embodiment having one or more features of the elevator system of any of the previous paragraphs, the portable device is configured to determine when the portable device is leaving or has left the site of the elevator system and provide a prompt for the maintenance personnel regarding a status of the maintenance mode of the at least one elevator car.

In an embodiment having one or more features of the elevator system of any of the previous paragraphs, the controller is configured to use stored information regarding a user-preferred elevator car position corresponding to the location of desired hoistway access and the stored information is associated with an identifier of maintenance personnel that previously provided information regarding the user-preferred elevator car position.

An illustrative example method of facilitating maintenance of an elevator system, which includes at least one elevator car that is moveable along a hoistway, includes automatically responding to a communication from a portable device indicating a desire for the at least one elevator car to be placed in a maintenance mode and indicating a location of desired hoistway access; automatically moving the at least one elevator car to a determined position based on the communication, the determined position corresponding to the location of desired hoistway access; performing at least one automated procedure to place the at least one elevator car in the maintenance mode based on the communication; and providing an indication to the portable device that the at least one elevator car is in the determined position and the at least one automated procedure is complete.

In an embodiment having one or more features of the method of the previous paragraph, the elevator system includes a second elevator car and the method includes determining an access level corresponding to the location of desired hoistway access, determining a boarding level where maintenance personnel can board the second elevator car, automatically causing the second elevator car to arrive at the boarding level based on the communication, and automatically causing the second elevator car to carry the maintenance personnel to the access level.

In an embodiment having one or more features of the method of any of the previous paragraphs, the at least one automated procedure comprises a plurality of automated procedures and the method includes performing the plurality of automated procedures in a predetermined order based on the location of desired hoistway access, and wherein the plurality of automated procedures includes at least verifying a condition of a safety chain associated with a plurality of hoistway doors along the hoistway and verifying a condition of a maintenance switch.

An embodiment having one or more features of the method of any of the previous paragraphs includes receiving the communication prior to arrival of maintenance personnel and the portable device at a site of the elevator system, moving the at least one elevator car to the determined position prior to or upon arrival of the maintenance personnel and the portable device at the site, and completing the plurality of automated procedures prior to or upon arrival of the maintenance personnel and the portable device at the site.

An embodiment having one or more features of the method of any of the previous paragraphs includes providing instructions regarding manual procedures needed to place the at least one elevator car in the maintenance mode prior to the maintenance personnel accessing the hoistway, confirming that the manual procedures are complete, and providing an indication that the elevator system is configured for the maintenance mode after the manual procedures are complete.

An embodiment having one or more features of the method of any of the previous paragraphs includes storing information regarding a user-preferred elevator car position corresponding to the location of desired hoistway access and associating the stored information with an identifier of maintenance personnel that previously provided information regarding the user-preferred elevator car position.

An illustrative example portable device for use by elevator maintenance personnel includes a transceiver configured to communicate with an elevator controller of an elevator system and a user interface configured to receive user input and to provide user output. The user input allows the maintenance personnel to indicate a desire for at least one elevator car to be placed in a maintenance mode and to indicate a location of desired hoistway access to the elevator controller. The user output indicates at least that the elevator car has arrived at the determined position.

In an embodiment having one or more features of the device of the previous paragraph, the transceiver is configured to receive instructions from the elevator controller regarding manual procedures needed to place the at least one elevator car in the maintenance mode prior to the maintenance personnel accessing the hoistway, the user interface is configured to provide an output corresponding to the manual procedures, the user interface is configured to receive input from the maintenance personnel indicating that the manual procedures are complete, and the transceiver is configured to provide a confirmation to the elevator controller when the manual procedures are complete.

In an embodiment having one or more features of the device of any of the previous paragraphs, the transceiver is configured to receive a communication from the elevator controller that the at least one elevator car is still in the maintenance mode after a first preselected period of time, the user interface is configured to provide an indication regarding ending the maintenance mode, and the user interface is configured to allow the maintenance personnel to provide an indication for the elevator controller regarding whether the maintenance personnel desires to end the maintenance mode.

In an embodiment having one or more features of the device of any of the previous paragraphs, the portable device is configured to determine when the portable device is leaving or has left the site of the elevator system and the user interface is configured to provide a prompt for the maintenance personnel regarding a status of the maintenance mode of the at least one elevator car.

An illustrative example non-transitory storage medium containing a plurality of processor-executable instructions includes: instructions to receive user input from maintenance personnel indicating a desire for at least one elevator car to be placed in a maintenance mode and indicating a location of desired hoistway access, instructions to communicate information corresponding to the user input with an elevator controller of an elevator system, and instructions to provide user output to the maintenance personnel indicating at least that the elevator car has arrived at the determined position.

Various features and advantages of at least one disclosed example embodiment will become apparent to those skilled in the art from the following detailed description. The drawings that accompany the detailed description can be briefly described as follows.

DETAILED DESCRIPTION

Embodiments of this invention facilitate automating the process of placing an elevator car into maintenance mode. A technician can use a portable communication device to provide an indication of desired access to the hoistway for the maintenance mode. The elevator system responds to the communication by automatically placing the elevator car in the necessary position and performing automated procedures needed to initiate maintenance mode. Embodiments of this invention, therefore, reduce the time and effort required of elevator maintenance personnel and facilitate more consistently establishing proper maintenance mode conditions.

Figure 1:
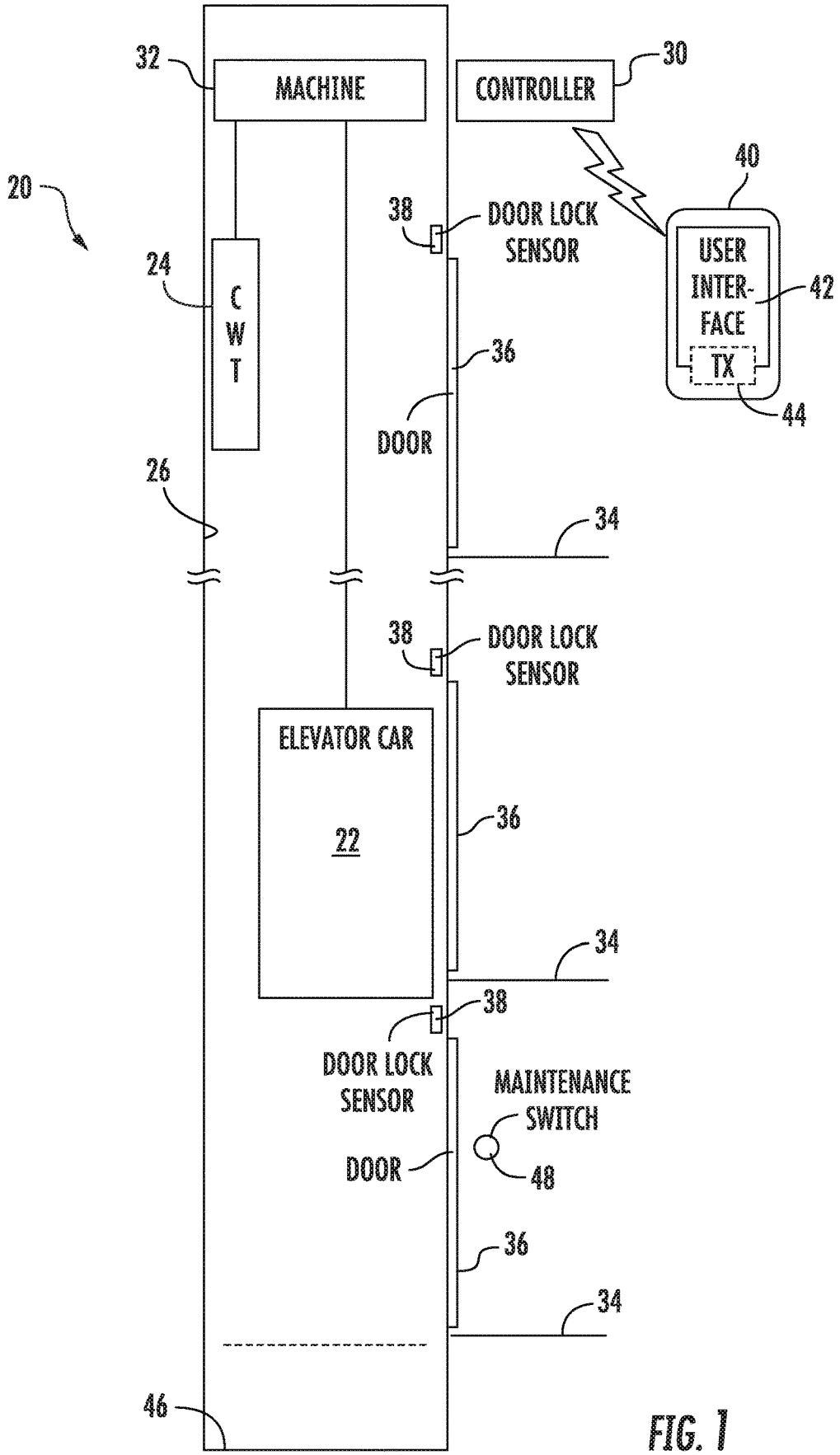
FIG. 1 schematically illustrates selected features of an elevator system designed according to an embodiment of this invention.

FIG. 1 schematically illustrates selected portions of an example elevator system 20. An elevator car 22 and counterweight 24 are situated for movement within a hoistway 26. An elevator controller 30 controls operation of a machine 32 for moving the elevator car 22 within the hoistway 26 among different landings 34, which correspond to floors or levels in a building for example. The hoistway 26 includes a plurality of doors 36 at the landings 34. Door lock sensors 38 provide an indication to the controller 30 regarding the condition of the doors 36, respectively. The door lock sensors 38 in some embodiments are part of a so-called chain that facilitates monitoring the condition or position of the doors 36 along the entire hoistway 26.

The elevator controller 30 is illustrated generically for discussion purposes. In some embodiments, the elevator controller 30 will be realized by suitably programming or configuring a portion of a controller or drive that is used for other elevator control features. In other embodiments the controller 30 is a dedicated computing device, such as a processor, located at the site of the elevator system. In other embodiments, the controller 30 is realized through cloud computing resources including one or more virtual machines running on at least one computing device located remotely from the site of the elevator system 20.

The example elevator system 20 includes a portable device 40 that can be carried about by elevator maintenance personnel. In some examples, the portable device 40 is a dedicated elevator service tool for use by authorized personnel. In other embodiments, the portable device 40 is a mobile station, such as a cell phone, tablet, laptop, smart watch, etc., that includes at least one application configured to facilitate initiating elevator system maintenance.

The portable device 40 in this example includes a user interface 42 that is configured to receive user input and to provide output for maintenance personnel. The output in some examples includes visible and audible indications. The portable device 40 includes a transceiver 44 for communicating with the elevator system controller 30 using known wireless communication techniques. In some embodiments such communications occur directly through a local area network to which the controller 30 has access. In other embodiments the portable device 40 communicates with remotely located cloud computing resources. In some embodiments, the portable device 40 includes at least a portion of a computing device that is considered part of the cloud computing resources.

When maintenance personnel desires to access the hoistway 26 for performing service or maintenance, the portable device 40 is useful for initiating that process. By using the user interface 42, maintenance personnel can communicate an intention to the controller 30 regarding a desire to access, for example, the top of the elevator car 22 or a pit 46 at the bottom of the hoistway 26. The controller 30 responds to such a communication by automatically moving the elevator car 22 to a position within the hoistway 26 that corresponds to the location where the elevator maintenance personnel desires access to the hoistway. By automatically capturing the elevator car at the appropriate position, the example system 20 significantly simplifies the task of establishing appropriate conditions in the elevator system 20 to begin maintenance.

Figure 2:
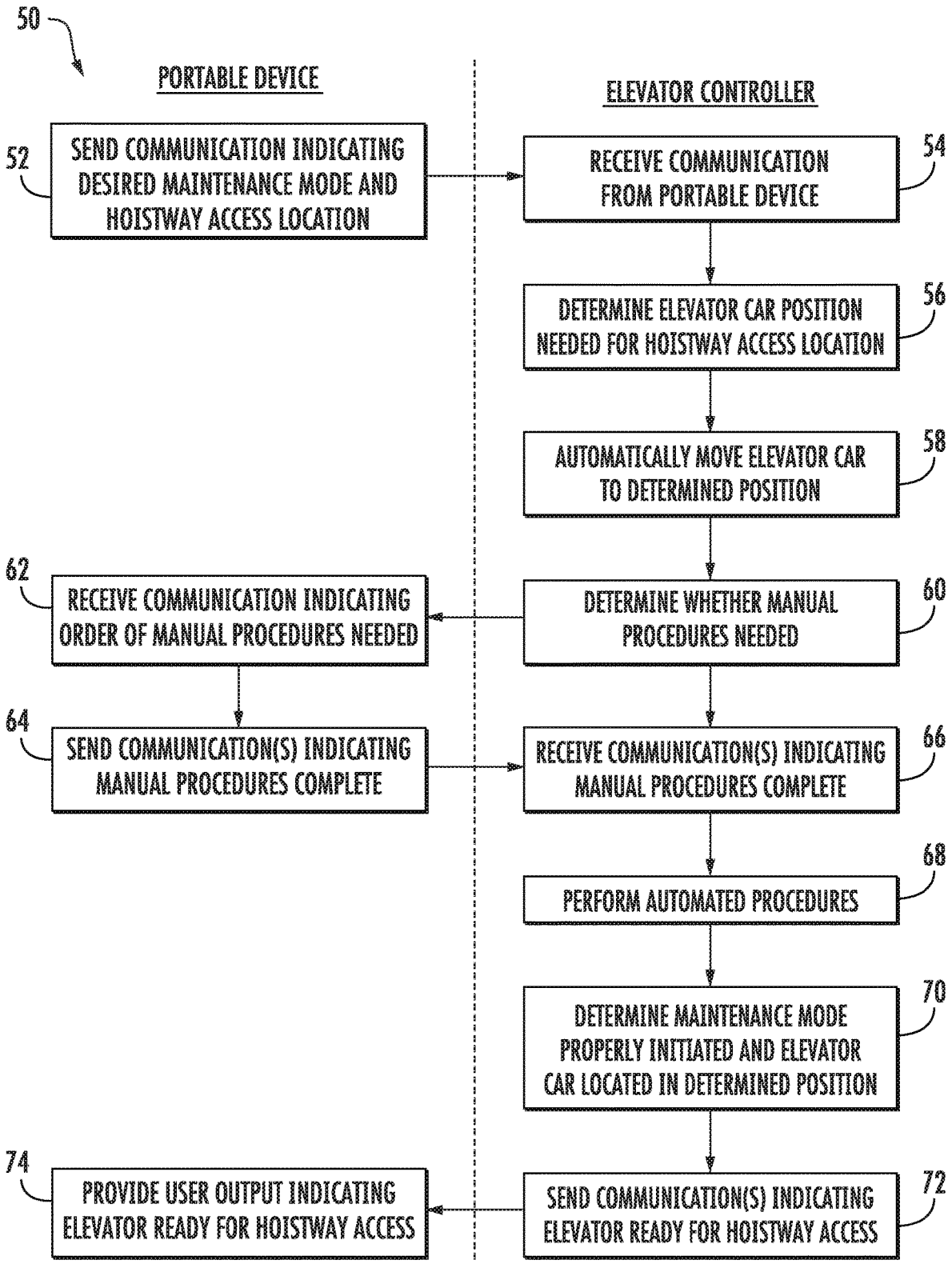
FIG. 2 is a flowchart style diagram summarizing an example method designed according to an embodiment of this invention.

FIG. 2 schematically summarizes a procedure including communications between the portable device 40 and the elevator controller 30. The flowchart diagram 50 begins at 52 where the maintenance personnel uses the portable device 40 to send a communication indicating a desire to place the elevator car 22 into maintenance mode and to access the hoistway 26. The communication at 52 indicates a desired hoistway access location, such as a specified one of the landings 34. At 54, the elevator controller receives the communication from the portable device 40. At 56, the elevator controller 30 determines the appropriate or corresponding elevator car position needed for the hoistway access location indicated in the communication from the portable device 40. For example, if the maintenance personnel desires to access the top of the elevator car 22 from a particular landing 34, the controller 30 determines a position of the elevator car 22 within the hoistway 26 to facilitate such access. At 58, the elevator controller automatically moves the elevator car 22 to the determined position.

Establishing proper conditions for maintenance mode sometimes requires that the maintenance personnel perform manual procedures and the controller 30 has access to information regarding such procedures stored in memory that is part of or accessible by the controller 30. At 60, the elevator controller 30 determines whether any such manual procedures are needed. If so, the controller 30 sends a communication to the portable device 40 regarding such procedures. At 62, the portable device 40 receives a communication indicating an order of manual procedures needed. The elevator maintenance personnel uses the portable device 40 as a guide for performing such procedures. In some embodiments, the user interface 42 allows an individual to provide one or more indications when one or more of the manual procedures are complete. At 64, the portable device 40 sends a communication to the elevator controller 30 regarding manual procedures that are complete. Such a communication may be a single communication after all procedures were complete or may be a series of communications upon completion of each individual procedure. At 66, the elevator controller 30 receives the communication indicating that any required manual procedures have been completed.

For example, when a mechanic desires access to the top of the elevator car 22 several steps or procedures are required and the controller 30 and portable device 40 guide the mechanic through such procedures. Once the elevator car 22 has arrived at the appropriate position in the hoistway 26, such as the top landing, so that the mechanic can enter the elevator car 22, the mechanic should place a preset number of in-car calls for the next floor and the lowest landing. The user interface 42 prompts the mechanic to place those calls. In one example, the controller 30 determines that such calls have been placed and communicates with the portable device 40 to acknowledge that the calls were successfully placed. The mechanic should next exit the car and subsequently unlock the hoistway door to verify that the open door switch at that landing results in the elevator car 22 stopping in flight. This is another that the controller 30 in some embodiments is capable of automatically recognizing or confirming.

With the car top appropriately positioned to allow the mechanic to step onto it, the mechanic should insert a mechanical blocking device or wedge in the hoistway doorway to hold that door open. The mechanic enters confirmation that this has been complete through the user interface 42 so the controller 30 can determine that this portion of the procedure is complete. The user interface 42 subsequently provides an indication or instruction to step onto the car top and engage the car top switch. The controller 30 may automatically determine when that switch has been properly engaged.

The mechanic should next exit the hoistway 26, close the landing door, wait some time and then reopen the door to confirm that the elevator car 22 has not moved. If the elevator car 22 is still properly positioned, the mechanic should reinstall the door block or wedge. The mechanic may indicate that these steps have been complete through the user interface 42 and the controller 30 may recognize or automatically confirm when the door is open or closed based on the status of the corresponding door lock switch. After completing further, similar steps, The mechanic will eventually be given permission to begin the intended maintenance through the user interface 42 after completing further, similar steps including, for example, turning on the top of car inspection switch, engaging a car top stop switch and turning on a top of car light. When the status of such switches or light is recognizable by the controller 30 completion of the corresponding step may be automatically determined but any steps that cannot be so determined will be confirmed by the controller 30 based on an indication provided by the mechanic through the user interface 42.

While some maintenance operations require manual procedures to prepare for such maintenance, others may include steps or procedures that can be automatically completed. In some embodiments, the user interface 42 provides information to the mechanic which of such procedures are automatically completed and those that have to be completed manually. At 68, the elevator controller 30 performs at least one automated procedure for establishing appropriate maintenance mode conditions. The number of automated procedures and any prescribed order of the automated procedures may vary depending on the location of desired hoistway access and the controller 30 in this example includes or has access to information regarding a predetermined order for such procedures. Example automated procedures include communicating with the portable device 40 to guide the mechanic through the pre-maintenance steps needed to establish appropriate conditions for performing the intended maintenance. Other automated procedures include making the determinations mentioned above while guiding the mechanic through the pre-maintenance steps. Some automated procedures do not require or involve a mechanic, such as determining a status of all of the elevator doors 36 based on information from the sensors 38. Another automated procedure includes determining a status of a maintenance switch 48, which may be automatically controlled by the elevator controller 30 in some embodiments. In some examples, the maintenance switch 48 has to be set to maintenance mode by the maintenance personnel and the automated procedures at 68 include verifying that the maintenance switch 48 has been appropriately set. Other automated procedures, which will become apparent to those skilled in the art who have the benefit of this description, are performed by the elevator controller in some example embodiments.

Another example automated procedure performed at 68 includes automatically moving a second elevator car to a landing where maintenance personnel may access that car and then moving the second elevator car to a level or landing corresponding to the location where hoistway access is desired. For example, when hoistway access is desired on an upper floor, the elevator controller 30 may cause a second elevator car, which is not the one to be placed into maintenance mode, to arrive at the lobby to pick up the maintenance personnel. That car will then carry the maintenance personnel to the upper level where hoistway access is desired.

At 70, the elevator controller determines that the maintenance mode has been properly initiated and that the elevator car is located at the determined position. At 72, the elevator controller sends one or more communications to the portable device 40 indicating that the elevator is ready for hoistway access. At 74, the portable device provides user output through the user interface 42 indicating that the elevator car 22 and the hoistway 26 are ready for hoistway access.

Communications between the portable device 40 and the elevator controller 30 in some embodiments occur even before the portable device 40 is brought to the site of the elevator system 20. When maintenance personnel is traveling to the site of the elevator system 20, the request for initiating maintenance mode can be communicated to the elevator controller 30 so that the appropriate conditions for beginning a maintenance procedure are at least partially established before the maintenance personnel arrives. For example, the elevator car 22 may already be in the determined position and some automated procedures may be complete before or upon arrival of maintenance personnel at the site.

The illustrated example simplifies the process of establishing appropriate conditions for performing maintenance on an elevator and better ensures that those conditions exist before maintenance personnel attempts to access the hoistway.

One feature of the illustrated example embodiment is that the controller 30, the portable device 40 or both have the capability to store user-preferred elevator car positions in the hoistway 26 for particular maintenance procedures. In an example embodiment, the controller 30 automatically stores a position where the elevator car 22 is located when an identified mechanic begins a maintenance procedure within the hoistway 26 as that individual user's preferred elevator car position for the corresponding maintenance procedure. Storing or saving settings for different procedures and customizing them for respective personnel further enhances efficiencies and convenience during future maintenance calls.

Another feature of the illustrated embodiment is that it facilitates avoiding unintentionally leaving the elevator car 22 in maintenance mode. The controller 30 determines if the maintenance mode has been in effect for a first preselected amount of time. If so, the controller communicates with the portable device 40 to provide an indication on the user interface 42 prompting maintenance personnel to return the elevator car 22 to normal operation mode or to indicate that maintenance is still ongoing. If a response is received to remove the elevator car from maintenance mode, the controller 30 places the car 22 back into normal operation mode. In some embodiments if no response to such a prompt is received after a second, longer amount of time has elapsed, the controller 30 will automatically return the elevator car 22 to normal operation mode. This feature avoids leaving a car out of service after maintenance is complete.

Another feature in some embodiments avoids unintentionally leaving a car in maintenance mode because the portable device 40 is configured to detect when its location changes in a manner that indicates the elevator personnel has left the site of the elevator system. Under such conditions the portable device provides a reminder prompt for elevator personnel to return the elevator car 22 to normal operation mode. Some embodiments include a series of prompts for a sequence of required steps that a mechanic should complete once maintenance is complete. For example, after maintenance that included pit access is complete, the user interface 42 sequentially guides the mechanic through steps to remove all tools and equipment from the pit, turn off the pit light, place pit switch into a run position, move the elevator car in the down direction (which can be completed through the user interface 42), place the elevator car 22 into normal operation, close any open hoistway doors including removing any mechanical door block, and confirm proper elevator operation before leaving the site.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system, comprising:

at least one elevator car that is moveable along a hoistway; and an elevator controller that is configured to:

respond to a communication from a portable device indicating a desire for the at least one elevator car to be placed in a maintenance mode and indicating a location of desired hoistway access, automatically move the at least one elevator car to a determined position based on the communication, the determined position corresponding to the location of desired hoistway access, perform at least one automated procedure to place the at least one elevator car in the maintenance mode based on the communication, and provide an indication to the portable device that the at least one elevator car is in the determined position and the at least one automated procedure is complete.

2. The elevator system of claim 1, comprising a second elevator car and wherein the controller is configured to:

determine an access level corresponding to the location of desired hoistway access, determine a boarding level where maintenance personnel can board the second elevator car, automatically cause the second elevator car to arrive at the boarding level based on the communication, and automatically cause the second elevator car to carry the maintenance personnel to the access level.

3. The elevator system of claim 1, wherein the location of desired hoistway access is one of on top of the at least one elevator car and a pit beneath the at least one elevator car.

4. The elevator system of claim 1, wherein the at least one automated procedure comprises a plurality of automated procedures; and the controller is configured to perform the plurality of automated procedures in a predetermined order based on the location of desired hoistway access.

5. The elevator system of claim 4, wherein the plurality of automated procedures includes at least verifying a condition of a plurality of hoistway doors along the hoistway and verifying a condition of a maintenance switch.

6. The elevator system of claim 5, wherein the elevator controller verifies the condition of the hoistway doors by determining whether any of the hoistway doors is open.

7. The elevator system of claim 5, wherein the elevator controller verifies the condition of the maintenance switch by at least one of automatically setting the maintenance switch into a maintenance mode position and determining whether the maintenance switch is in the maintenance mode position.

8. The elevator system of claim 1, wherein the controller is configured to receive the communication prior to arrival of maintenance personnel and the portable device at a site of the elevator system;

move the at least one elevator car to the determined position prior to or upon arrival of the maintenance personnel and the portable device at the site; and complete at least one automated procedure prior to or upon arrival of the maintenance personnel and the portable device at the site.

9. The elevator system of claim 1, comprising the portable device and wherein the portable device comprises a user interface that is configured to allow maintenance personnel to indicate the desire for the at least one elevator car to be placed in the maintenance mode and the location of desired hoistway access to the elevator controller; and provide an output to the maintenance personnel indicating at least that the elevator car has arrived at the determined position.

10. The elevator system of claim 9, wherein the portable device is configured to receive instructions from the elevator controller regarding at least one manual procedure needed to place the at least one elevator car in the maintenance mode prior to the maintenance personnel accessing the hoistway;

provide an output corresponding to the at least one manual procedure;

receive input from the maintenance personnel indicating that the at least one manual procedure is complete; and provide a confirmation to the elevator controller when the at least one manual procedure is complete.

11. The elevator system of claim 9, wherein the elevator controller determines whether the at least one elevator car is still in the maintenance mode after a first preselected period of time;

the elevator controller communicates with the portable device indicating that the at least one elevator car is still in the maintenance mode after the first preselected period of time;

the portable device provides an output for maintenance personnel regarding ending the maintenance mode; and the elevator controller ends the maintenance mode after receiving an indication from the portable device to end the maintenance mode or expiration of a second, longer preselected period of time.

12. The elevator system of claim 9, wherein the portable device is configured to determine when the portable device is leaving or has left the site of the elevator system; and provide a prompt for the maintenance personnel regarding a status of the maintenance mode of the at least one elevator car.

13. The elevator system of claim 1, wherein the controller is configured to use stored information regarding a user-preferred elevator car position corresponding to the location of desired hoistway access; and the stored information is associated with an identifier of maintenance personnel that previously provided information regarding the user-preferred elevator car position.

14. A method of facilitating maintenance of an elevator system that includes at least one elevator car that is moveable along a hoistway, the method comprising:

automatically responding to a communication from a portable device indicating a desire for the at least one elevator car to be placed in a maintenance mode and indicating a location of desired hoistway access;

automatically moving the at least one elevator car to a determined position based on the communication, the determined position corresponding to the location of desired hoistway access;

performing at least one automated procedure to place the at least one elevator car in the maintenance mode based on the communication; and providing an indication to the portable device that the at least one elevator car is in the determined position and the at least one automated procedure is complete.

15. The method of claim 14, wherein the elevator system includes a second elevator car and the method comprises determining an access level corresponding to the location of desired hoistway access, determining a boarding level where maintenance personnel can board the second elevator car, automatically causing the second elevator car to arrive at the boarding level based on the communication, and automatically causing the second elevator car to carry the maintenance personnel to the access level.

16. The method of claim 14, wherein the at least one automated procedure comprises a plurality of automated procedures and the method comprises performing the plurality of automated procedures in a predetermined order based on the location of desired hoistway access; and wherein the plurality of automated procedures includes at least verifying a condition of a safety chain associated with a plurality of hoistway doors along the hoistway and verifying a condition of a maintenance switch.

17. The method of claim 14, comprising receiving the communication prior to arrival of maintenance personnel and the portable device at a site of the elevator system;

moving the at least one elevator car to the determined position prior to or upon arrival of the maintenance personnel and the portable device at the site; and completing at least one automated procedure prior to or upon arrival of the maintenance personnel and the portable device at the site.

18. The method of claim 17, comprising providing instructions regarding manual procedures needed to place the at least one elevator car in the maintenance mode prior to the maintenance personnel accessing the hoistway;

confirming that the manual procedures are complete; and providing an indication that the elevator system is configured for the maintenance mode after the manual procedures are complete.

19. The method of claim 14, comprising storing information regarding a user-preferred elevator car position corresponding to the location of desired hoistway access; and associating the stored information with an identifier of maintenance personnel that previously provided information regarding the user-preferred elevator car position.

20. A portable device for use by elevator maintenance personnel, the device comprising:

a transceiver configured to communicate with an elevator controller of an elevator system; and a user interface configured to receive user input and to provide user output, the user input allowing the maintenance personnel to indicate a desire for at least one elevator car to be placed in a maintenance mode and to indicate a location of desired hoistway access to the elevator controller, the user output indicating at least that the elevator car has arrived at the determined position.

21. The portable device of claim 20, wherein the transceiver is configured to receive instructions from the elevator controller regarding manual procedures needed to place the at least one elevator car in the maintenance mode prior to the maintenance personnel accessing the hoistway;

the user interface is configured to provide an output corresponding to the manual procedures;

the user interface is configured to receive input from the maintenance personnel indicating that the manual procedures are complete; and the transceiver is configured to provide a confirmation to the elevator controller when the manual procedures are complete.

22. The portable device of claim 20, wherein the transceiver is configured to receive a communication from the elevator controller that the at least one elevator car is still in the maintenance mode after a first preselected period of time;

the user interface is configured to provide an indication regarding ending the maintenance mode; and the user interface is configured to allow the maintenance personnel to provide an indication for the elevator controller regarding whether the maintenance personnel desires to end the maintenance mode.

23. The portable device of claim 20, wherein the portable device is configured to determine when the portable device is leaving or has left the site of the elevator system; and the user interface is configured to provide a prompt for the maintenance personnel regarding a status of the maintenance mode of the at least one elevator car.

24. A non-transitory storage medium containing a plurality of processor-executable instructions, comprising:

instructions to receive user input from maintenance personnel indicating a desire for at least one elevator car to be placed in a maintenance mode and indicating a location of desired hoistway access;

instructions to communicate information corresponding to the user input with an elevator controller of an elevator system; and instructions to provide user output to the maintenance personnel indicating at least that the elevator car has arrived at the determined position.

* * * * *